United States Patent [19]

Mitchell

[11] Patent Number: 4,599,752

[45] Date of Patent: Jul. 15, 1986

[54] COMBINATION INTERLOCKING CAP FOR SPORTS' HELMET

[76] Inventor: Steven C. Mitchell, 27612 Soltero, Mission Viejo, Calif. 92691

[21] Appl. No.: 623,235

[22] Filed: Jun. 21, 1984

[51] Int. Cl.[4] ..... A42B 3/00

[52] U.S. Cl. ..... 2/425; 2/422

[58] Field of Search ..... 2/425, 422, 410, 187

[56] References Cited

U.S. PATENT DOCUMENTS

| | | | |
|---|---|---|---|
| 3,155,981 | 11/1964 | McKissick et al. | 2/422 |
| 3,245,087 | 4/1966 | Marchello | 2/422 |
| 3,435,460 | 4/1969 | Grant | 2/422 |
| 3,445,860 | 5/1969 | Rodell | 2/422 |

*Primary Examiner*—Werner H. Schroeder
*Assistant Examiner*—J. Olds
*Attorney, Agent, or Firm*—Ben E. Lofstedt

[57] ABSTRACT

An improved combination sports' helmet and interlocking cap is disclosed including a helmet having a crown portion and a pair of ear portions and including a dual pair of receptacles disposed therein, one pair of receptacles disposed on the crown thereof, and the other pair disposed in the ear portions thereof; a cap for the helmet adapted to mate over the exterior portion of the helmet in near conformity therewith, said cap having a dual pair of male interlocking portions therein, one of said pair of male interlocking portions being operably adapted to removably interlock with the pair of receptacles disposed on the crown of the helmet, and the other pair of said male interlocking portions being operably adapted to removably interlock with said pair of receptacles disposed in the ear portions of the helmet. The cap can be engaged with and disengaged from the helmet in a matter of seconds. Use of the cap permits the sports coach, fans and players to visually distinguish between one team of players over another team of players. It is especially useful where only one color or specially marked helmet is available for use.

9 Claims, 3 Drawing Figures

Figure 1
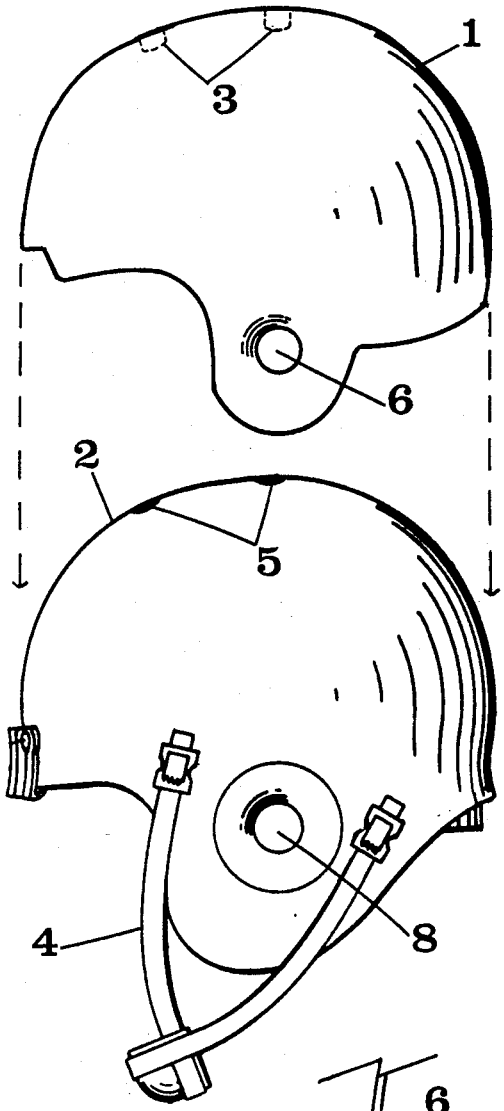
Figure 2
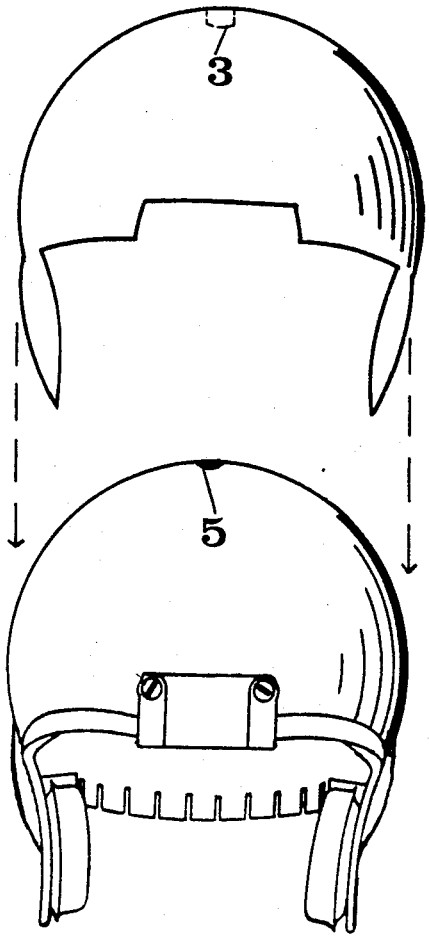
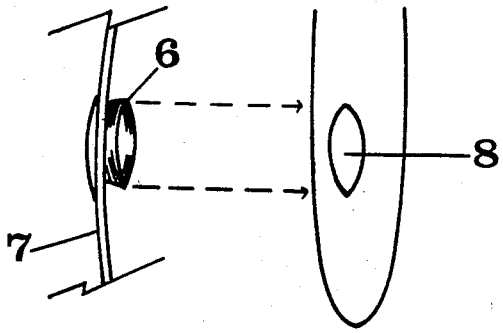
Figure 3

COMBINATION INTERLOCKING CAP FOR SPORTS' HELMET

BACKGROUND OF THE INVENTION

1. Field of the Invention

The present invention relates to sports helmets, and, more particularly to, removable caps for sports helmets.

2. Description of the Prior Art

Many contact sport activities require the use of various items of safety equipment, such as hard plastic helmets by which to protect the human cranial structure.

Having been involved with the game of football for over 20 years, both as a player and coach, I saw the need to more clearly distinguish both individuals and teams during practice and scrimmage periods. The most common accepted method to this point is the use of a thin mesh pullover vest of contrasting color. I felt that during the seemingly uncontrolled mass of humanity which occurs during a scrimmage, these vests were at best inadequate. I did note that the most noticable object I saw as I scanned over the field were bright, round, shinny objects-football helmets. Thus the idea was conceived to distinguish individuals and teams by changing the color of the helmets. The change would need to be made quickly and easily as personnel and positions changed. From this I developed the idea of a thin plastic skin or "shell" which would snap on and off quickly and would be used in conjunction with or without the scrimmage vest. At the same time I saw the need for this Shell to have the ability to be permanently installed for the purpose of changing color or refurbishing a badly worn helmet.

SUMMARY OF THE INVENTION

The improved combination sports' helmet with a removable interlocking cap of the present invention is designed to provide an improved combination sports' helmet which incorporates a removable, interlocking cap which may be snapped on and off the helmet in a matter of seconds. The cap portion of the present invention is designed to be applied even with the face mask and chin strap of the helmet portion in place. The cap is constructed of a flexible, high impact plastic approximately 1/16 of an inch in thickness. The inner surface of the Shell is designed to comformably match the outer surface of the helmet, thus creating an almost air tight seal when applied. When applying the cap, all hardware is removed from the helmet. The cap is installed and holes are drilled where needed. All hardware is then reinstalled on the helmet.

BRIEF DESCRIPTION OF THE DRAWINGS

The advantages of the invention will become more apparent from the specifications when in conjunction with the accompanying drawings, in which: FIG. 1 is a side elevational view of both the cap and a football helmet shown in breakaway assembly form and illustrating the method of installation. FIG. 2 is a front elevational view of both the improved cap and helmet combination of the present invention and illustrating the method of installation. FIG. 3 is an enlarged view of the ear portions of the cap and helmet and illustrates the means by which the ear portion of the cap is removably secured to the ear hole of the helmet.

DETAILED DESCRIPTION OF THE INVENTION

With continuing reference to FIGS. 1, 2, and 3 of the drawing, there is shown and illustrated the present invention which consists of an improved combination cap and sports' helmet basically comprising: a cap 1, a sports' helmet 2, first means for removably interlocking the cap 1 and the sports' helmet 2 so as to prevent side-to-side movement therebetween, and second means for removably interlocking the cap 1 and the helmet 2 so as to prevent front-to-back movement therebetween. The cap 1 is typically a plastic shell of contrasting color used to distinguish one sports' player from another, such as, for example, the offensive team from the defensive team during a football practice scrimmage. The cap 1 is secured in place by means of ear hole snaps (6) which are formed as an integral part of the cap 1 which are adapted to be press-fitted and snapped into an interlocking relationship with the rim of the ear hole 8 of the sports' helmet 2.

While some of the prior art designs incorporated some type of interlocking means between the cap 1 and the sports' helmet 2, none provided an improved combination interlocking means which fixed the orientation and interrelationship between the cap 1 and the sport's helmet 2 with inherent vacuum release capabilities to provide a means for releasing the air vacuum frequently created by the inherently conformal mating between the inside surface contour of the cap 1 and the external surface contour of the sports' helmet 2. Such fixed orientation and interrelationship and vacuum release is provided by a combination of vent holes 5 drilled, or otherwise formed, in the crown of the sports' helmet 2 and complementarily arranged plug elements 3 formed on the inside of the cap 1.

When the cap 1 is conformably mated with and over the sports' helmet 2, the plugs 3 are located so as to mate with the vent holes 5 in the helmet 2. The ear hole snaps 6 are each aligned with the ear holes 8 of the sports' helmet 2 and manually engaged therewith as shown in FIG. 3.

It should be quite clearly understood that the interlocking engagement of the ear hole snaps 6 of the cap 1 with the ear holes 8 of the sports' helmet 2 prevents side-to-side movement between the cap 1 and the sports' helmet 2. On the other hand, without further interlocking means, the cap 1 and the helmet 2 would still allow front-to-back movement. Such front-to-back movement between the cap 1 and the sport's helmet 2 is prevented by the combination of the second interlocking means composed of the pair of vent holes 5 in the sports' helmet 2 together with the mating vent hole plugs 3 formed on the inside of the cap 1. The cap 1 is constructed of a flexible, high impact plastic material. The cap 1 is formed of plastic material which is approximately 1/16 of an inch in thickness. The process used to manufacture the cap 1 is that of mold injection. The color of the cap 1 may either be determined at the time of manufacture by the use of pigmented plastic, or after manufacture (by the use of transparent plastic which is colored by painting such transparent plastic material. With the use of transparent plastic, the finished cap 1 would be transparent and color would be achieved by painting the inner surface of the finished cap 1. The inner surface of the cap 1 is designed to duplicate the outer surface of the sports' helmet 2. The finished cap 1 will thus create an almost air tight seal when applied.

The cap 1 is not designed to serve as protective headwear by itself. The cap 1 must be used in comjunction with a certified sports' helmet 2. It is also noted that the use of the cap 1 does not compromise or deter the safety features of the sports' helmet 2. While a removable embodiment of the invention is shown and illustrated herein which will find widespread use and application in, for example, scrimmage and/or practice football games between the first and second string football teams from the same school, the present invention is not intended to be limited to such use and application. For example, the cap 1 is designed to snap on and off with all existing hardware on the helmet, a portion of the helmet 2 remains uncovered. On some occasions, it is highly desirable to permanently affix the cap 1 to the sports' helmet 2 so that it is not readily removable therefrom. For this purpose a permanently installed cap 1 is utilized. Incorporating all of the features of the easily removable cap 1, the permanently installed cap 1 is designed for permanent installation and covers the entire outer surface of the sports' helmet 2. With all hardware 4 removed from the helmet 2, the permanent cap 1 is mated with the helmet 2, holes drilled where necessary, and all hardware (chin strap, etc.) 4 reinstalled. The permanent cap 1 is an excellent choice for giving a badly worn football or sports' helmet 2 a bright new finish, or changing the color of the helmet 2 if so desired. The process of assembly and the materials used may vary. Such would not constitute a departure from the spirit and scope of the invention presented herein. This would also be true of the application. Although the cap 1 is illustrated herein for application on a football helmet 2, with minor modifications the cap 1 could be utilized in conjunction with any protective headwear.

While two embodiments of the present invention have been discussed and disclosed herein, such is intended to be illustrative by way of example only and is not intended to be in any limiting the scope or breadth of the instant invention herein, as the boundaries of such invention are intended to be limited only by the scope of the claims appended hereto.

I claim:

1. An improved interlocking cap for a helmet, comprising:

(a) a thin rigid plastic cap adapted for use as a conformable cover for the exterior surface of a helmet, the cap having a least a pair of male plugs projecting from the inside surface thereof adjacent the crown portion thereof, the pair of male plugs being disposed in spaced-apart relationship to one another, said plugs being adapted to interlockingly mate with corresponding, complementary receptacles in the helmet to prevent front-to-back movement therebetween, and further having a pair of ear hole plugs alignably adapted to be mated to the corresponding pair of ear holes in the helmet, which when mated therewith, said removably interlocking relationship prevents side-to-side movement therebetween.

2. An improved interlocking cap for a helmet as described in claim 1, which when installed on a helmet, creates an almost air tight seal.

3. An improved interlocking cap for a helmet as described as claim 2 which when manufactured by means of mold injection will be formed as a single structure.

4. An improved interlocking cap for a helmet as described in claim 1 having an opaque finish of any desired color.

5. An improved interlocking cap for a helmet as described in claim 1 having a transparent, colorless finish.

6. The cap of claim 1 wherein said cap is formed of a thin plastic shell and has a first means for interlocking said shell to the helmet to prevent relative front-to-back movement between the cap and the helmet, wherein said first means includes a pair of male plugs protruding therefrom and disposed on the inside of the crown of the shell.

7. The cap of claim 6 further having a second means independent of said first means for preventing relative front-to-back movement between the shell and the helmet, said second means for preventing relative side-to-side movement between the shell and the helmet, wherein said second means includes:

(a) a plurality of protrusions projecting from the inside portion of the shell forming the body of the cap; and (b) means disposed in the helmet for interlockingly receiving the protrusions on the shell thereinto.

8. The cap of claim 7 wherein said protrusions and two male plugs are disposed in a spaced-apart relationship.

9. The cap of claim 8 wherein said means disposed in the helmet for interlockingly receiving the male plugs are a pair of receptacles operably alignable in corresponding relationship therewith and adapted to receive said plugs thereinto.

* * * * *